United States Patent [19]

Hatanaka

[11] 4,257,565

[45] Mar. 24, 1981

[54] DESK-TOP SHREDDER

[75] Inventor: Takefumi Hatanaka, Matsudo, Japan

[73] Assignee: Lifewell Corporation, Tokyo, Japan

[21] Appl. No.: 961,745

[22] Filed: Nov. 17, 1978

[30] Foreign Application Priority Data

Oct. 11, 1978 [JP] Japan ..... 53/124089

[51] Int. Cl.[3] ..... B02C 18/22

[52] U.S. Cl. ..... 241/100; 83/500; 83/664; 241/236

[58] Field of Search ..... 241/100, 167, 236; 83/500–503, 664

[56] References Cited

U.S. PATENT DOCUMENTS

| | | | |
|---|---|---|---|
| 1,178,386 | 4/1916 | Edwards | 241/236 X |
| 2,770,302 | 11/1956 | Lee | 83/500 X |
| 3,682,402 | 8/1972 | Goldhammer | 241/100 |
| 3,960,335 | 6/1976 | Haberle | 241/236 |
| 4,018,392 | 4/1977 | Wagner | 241/236 X |

*Primary Examiner*—Howard N. Goldberg

*Attorney, Agent, or Firm*—Robert E. Burns; Emmanuel J. Lobato; Bruce L. Adams

[57] ABSTRACT

An electrically driven desk-top shredder which comprises a housing, a drive motor secured within said housing, and a shredding mechanism driven by said drive motor. The shredding mechanism comprises a pair of rotary shafts driven in mutually opposite directions by said motor, a plurality of rotary disks mounted on said rotary shafts and having a plurality of shredding blade about the outer periphery thereof, and a plurality of spacer members each having at least one cutting edge that engages with the shredding plate of a respective rotary disk in a gap formed between a pair of adjacent rotary disks.

6 Claims, 4 Drawing Figures

DESK-TOP SHREDDER

BACKGROUND OF THE INVENTION

This invention relates to a document shredder, and more particularly to a compact, electrically driven desk-top shredder especially for executive use in government, industry or related organizations.

Although various kinds of electrically driven desk-top shredders have heretofore been proposed, these shredders are comparatively large in size and thus occupy a large amount of desk space. Furthermore the fragments which result from the shredding of documents are discharged into a plastic bag secured to the outside of the shredder case, a defect which detracts from both the appearance of the room and the performance of the machine. In agencies or organizations within the government or industry upper echelon personnel generally deal with a great number of documents which become unnecessary and which must be destroyed by a shredder. In order to destroy these unnecessary documents such personnel must leave their desks and themselves make use of a shredder at a remote location. This not only consumes time but also lowers business efficiency since such key staffmembers handle more of these documents than do other personnel.

SUMMARY OF THE INVENTION

It is therefore an object of the present invention to provide a compact, electrically driven desk-top shredder which occupies an extremely small amount of space.

It is another object of the present invention to provide an electrically driven desk-top shredder especially for executive use in government, industry or related organizations, thereby contributing to an improvement in business efficiency.

It is still another object of the present invention to provide an electrically driven desk-top shredder adapted to finely shred unnecessary documents into chip-like fragments of an extremely small size thereby to completely prevent intelligence leaks.

DESCRIPTION OF THE PREFERRED EMBODIMENT

Figure 1:
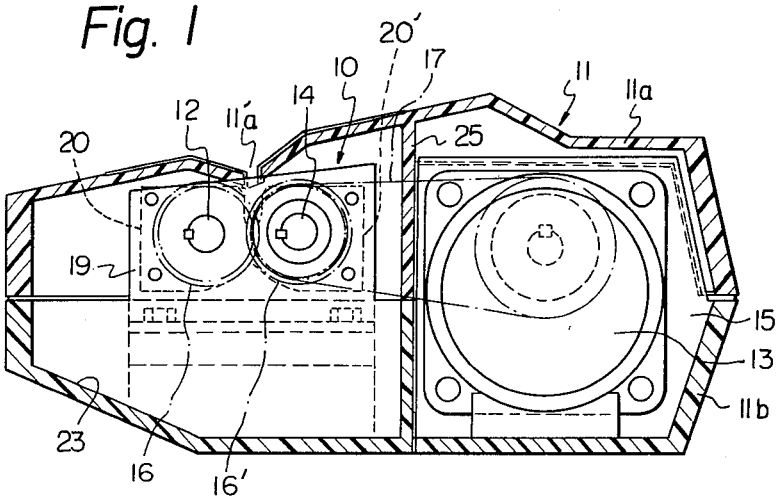
FIG. 1 is a transverse sectional view of a desk-top shredder in accordance with the present invention.
Figure 2:
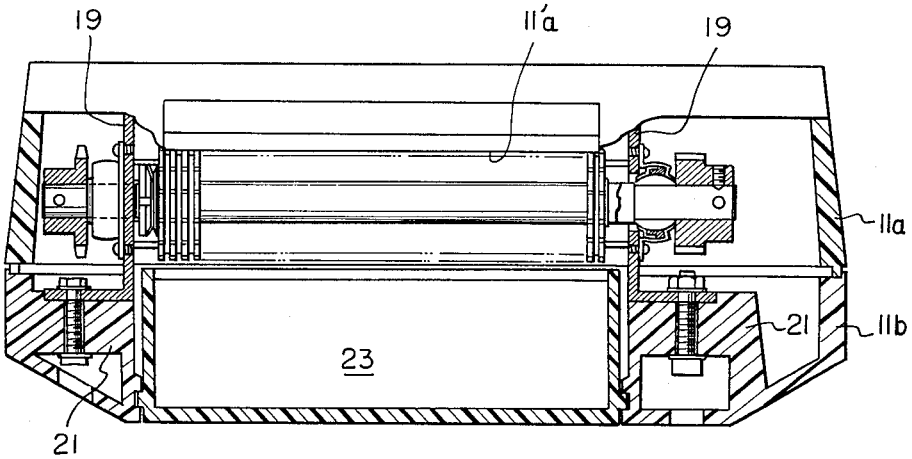
FIG. 2 is a longitudinal sectional view of the desk-top shredder shown in FIG. 1.

Referring now to FIG. 1, a preferred embodiment of an electrically driven desk-top shredder in accordance with the present invention comprises a housing 11 composed of an upper case 11*a* and lower case 11*b*, a drive motor 13 provided at the rear of housing 11, and a shredding mechanism 10 driven by the drive motor 13. The drive motor 13 is secured by bolts or other suitable means to a flange 15 provided on lower case 11*b*. Designated at 17 is a power transmission member for transmitting the power of drive motor 13 to the shredding mechanism 10. The shredding mechanism 10 and a chip receptacle 23 are arranged in front of drive motor 13 and are provided in an area at approximately the same height as that of the drive motor. The shredding mechanism 10 is secured through a frame 19 to the base 21 of lower case 11*b*. Upper case 11*a* has a slot 11'*a* which is open above shredding mechanism 10. The chip receptacle 23 is detachably mounted on lower case 11*b* below the shredding mechanism. Designated at 25 is a partition which prevents the chips from penetrating the motor 13.

Figure 3:
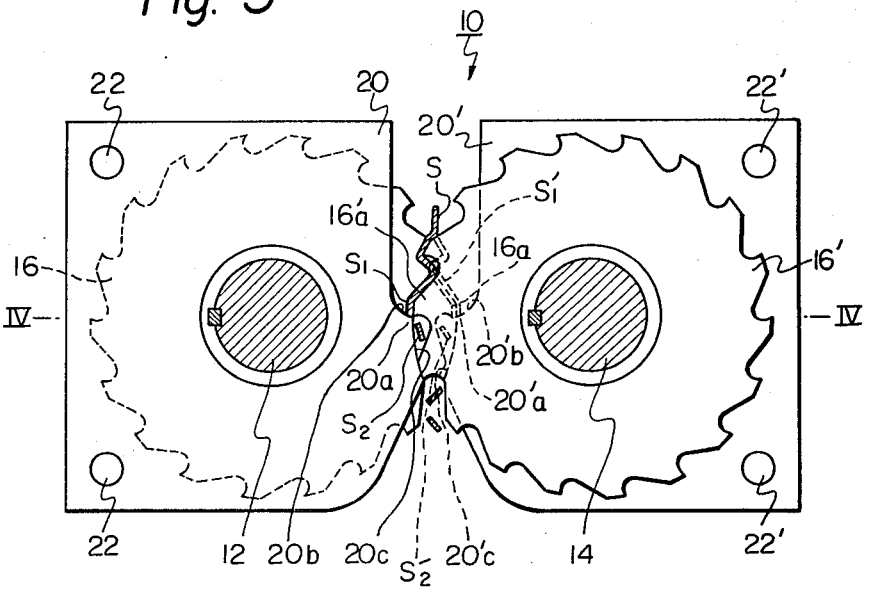
FIG. 3 is a front view of a principal portion of the shredding mechanism.
Figure 4:
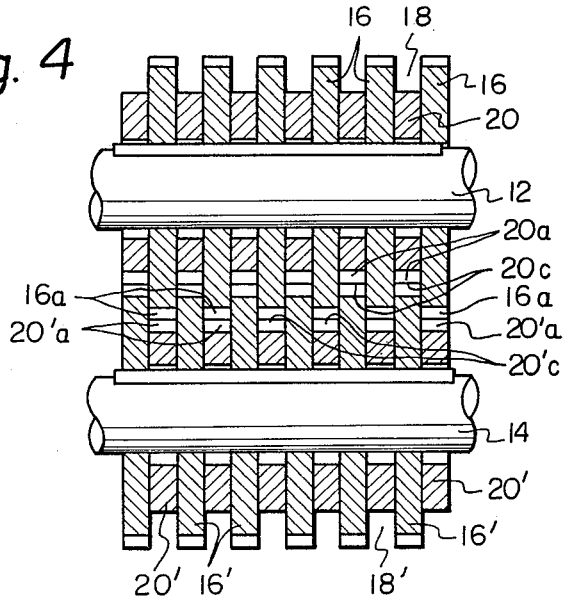
FIG. 4 is a cross-sectional view taken along the line IV—IV of FIG. 3.

The construction of shredding mechanism 10 is shown in more detail in Figs. 3 and 4. Shredding mechanism 10 comprises a pair of rotary shafts 12, 14 disposed in parallel and rotatable in mutually opposite directions by means of moter 13. As can be more clearly seen in FIG. 4, a plurality of rotary disks 16, 16' are axially disposed along each of the shafts 12, 14 and secured thereto by keys or other suitable means. The rotary disks 16, 16' are alternately disposed along the axial direction such that a portion of the side surface of one disk abuts against a portion of the side surface of another, with gaps 18, 18' being formed between adjacent rotary disks 16, 16' and having approximately the same width as each disk. Formed about the outer periphery of each rotary disk are a plurality of suitably spaced shredding blades 16*a*, 16'*a* disposed so as to cut into both sides of a sheet-like material S at approximately the same time. However, it is also permissible to arrange the rotary disks 16, 16' in such a manner that the sheet-like material is simultaneously cut into by the edges of the shredding blades on one rotary disk and the outer periphery of the other rotary disk.

Spacer members 20, 20' are disposed in respective gaps 18, 18'. These spacer members 20, 20' are secured to the shredder frame (not shown) by stationary shafts 22, 22' or other suitable means. Spacer members 20, 20' include, respectively, engaging surfaces 20*c*, 20'*c* that engage with the outer peripheries of shredding blades 16'*a*, 16*a* on the opposing rotary disks 16', 16, and at least one cutting edge 20*a*, 20'*a* provided above the respective engaging surfaces 20*c*, 20'*c*. The cutting edges 20*a*, 20'*a* engage with the outer peripheries of shredding blades 16'*a*, 16*a* on the opposing rotary disks 16', 16 in the gaps 18, ~'. As depicted in FIG. 1 the stationary cutting members 20, 20' further include respective guiding surfaces 20*b*, 20'*b* for guiding the sheet-like material S to the blade portions 20*a*, 20'*a* in gaps 18, 18'. b In accordance with this construction the sheet-like material S is longitudinally cut into strips $S_1$, $S'_1$ by the shredding blades 16*a*, 16'*a* of the rotary disks 16, 16'. The lower portions of the strips $S_1$, $S'_1$ are fed between the cutting edges 20*a*, 20'*a* of the spacer members and the opposing shredding blades 16'*a*, 16*a* of the rotary disks 16', 16 in the gaps 18, 18' by means of the guiding surfaces 20*b*, 20'*b* of the respective spacer members 20, 20'. The strips $S_1$, $S'_1$ are then finely and reliably cut into chip-like fragments $S_2$, $S'_2$ since the shredding blades 16'*a*, 16*a* engage with respective cutting edges 20*a*, 20'*a* of stationary cutting members 20, 20' in the gaps 18, 18'. The strips $S_1$, $S'_1$ are cut into the chip-like fragments $S_2$, $S'_2$ in an extremely reliable manner since the strips are guided in the direction of the cutting edges 20*a*, 20'*a* without fail by the guiding surfaces 20*b*, 20'*b* of spacer members 20, 20' in the gaps 18, 18' and further because the shredding blades 16'*a*, 16*a* of the rotary disks engage with the opposing cutting edges of respeetive spacer members 20, 20' in gaps 18, 18'. Moreover, outstanding effects are obtained in that waste materials can be shredded into chips of a small size not formerly attainable in the prior art disintegrators. This is accomplished by arranging the pitch of the shredding blades such that the cutting edges of the spacer members are set at the upper side of the small rotary disks, that is, such that the cutting edges are set close to the point at which the shredding blades 16*a*, 16′*a* of the rotary disks 16, 16′ initially engage.

The desk-top shredder in accordance with the present invention as described above adopts an extremely reliable shredding mechanism and therefore shreds unnecessary documents into small chip-like fragments without fail. It is accordingly possible to completely prevent intelligence leaks from documents shredded by the mechanism. It is also possible to provide a desk-top shredder which is compact in construction by disposing the shredding mechanism and chip receptacle in a portion of the housing having approximately the same height as that of the motor. However, it is to be understood that the motor, shredding mechanism and chip receptacle are in no way restricted to the abovementioned arrangement but may be arranged in any suitable manner.

What is claimed is:

1. An electrically driven desk-top shredder for cutting document sheets into small fragments, comprising:

a housing having a document-receiving slot through an upper portion of said housing and dimensioned to permit documents to be inserted through said slot and into said housing;

a drive motor fixedly mounted within said housing at a rear portion thereof;

a removably mounted receptacle for receiving small fragments of shredded documents;

mounting means removably mounting said receptacle at a lower portion of said housing and forward of said drive motor; and a shredding mechanism and means coupling said shredding mechanism to said drive motor for driving said shredding mechanism with said drive motor, said shredding mechanism mounted within said housing below the slot through the upper portion of said housing and above said receptacle for receiving in use a document to be shredded which is inserted into said shredding mechanism through the slot and for depositing chips produced in use during shredding of the document into said receptacle below said shredding mechanism, and said shredding mechanism being mounted forward of said drive motor with the uppermost part of said shredding mechanism being substantially no higher than the uppermost part of said drive motor, wherein said shredding mechanism is comprised of;

first and second parallel shafts mounted for rotation in opposite directions;

a first plurality of discs fixed on said first shaft for rotation with said first shaft and spaced at intervals along the length of said first shaft, each of said discs having a plurality of shredding blades peripherally mounted thereon and spaced circumferentially thereof;

a second plurality of discs fixed on said second shaft for rotation with said second shaft and spaced at intervals along the length of said second shaft, each of said discs having a plurality of shredding blades peripherally mounted thereon and spaced circumferentially thereof;

adjacent discs of said first plurality of discs defining spaces therebetween, adjacent discs of said second plurality of discs defining spaces therebetween, and said first and second parallel shafts relatively positioned with respective discs of said first plurality of dsics inserted between adjacent discs of said second plurality of discs and with respective discs of said second plurality of discs inserted between adjacent discs of said first plurality of discs;

a plurality of stationary spacers each mounted between a respective adjacent pair of discs in one plurality of discs and opposite a corresponding disc in the other plurality of discs, each of said spacers having a thickness slightly less than its corresponding disc and having a peripheral contour defining a guide surface leading down toward said first and second plurality of discs and an arcuate surface opposite and adjacent the corresponding disc and extending upwardly toward and meeting said guide surface at a certain angle, said guide surface and said arcuate surface meeting at an edge defining a cutting edge on said spacer, and said cutting edge of said spacer being positioned close to the circular locus of the outermost portions of said shredding blades;

whereby rotation of said first and second parallel shafts in opposite directions and in directions so that said shredding blades first approach said cutting edges and then sweep past said arcuate surfaces of said spacers is effective to shred documents inserted between said first plurality and said second plurality of rotating discs, wherein each such document is first cut into a plurality of strips by a shearing action between said first plurality of rotating discs and said second plurality of rotating discs, said strips being formed between adjacent pairs of said first plurality of rotating discs and between adjacent pairs of said second plurality of rotating discs, and each of said strips then being guided by the guide surface of a corresponding spacer to advance between the cutting edge of the corresponding spacer and the shredding blades of the rotating disc opposite the corresponding spacer, and successive fragments being successively cut from each advancing strip as successive shredding blades sweep past the cutting edges and the arcuate surfaces as the corresponding discs rotate.

2. A shredder according to claim 1, wherein the cutting edge of each spacer is a straight edge extending transversely across each space.

3. A shredder according to claim 1, wherein the shredding blade of each disc is a straight blade parallel to said pair of parallel shafts.

4. A shredder according to claim 1, wherein the height of the forward portion of said housing is substantially equal to the combined height of said receptacle and said shredding mechanism positioned above said receptacle.

5. A shredder according to claim 1, wherein said mounting means mounts said receptacle for removal from said housing from the front of said housing.

6. A shredder according to claim 1, wherein said shredding mechanism is mounted with the respective longitudinal axes of said first and second parallel shafts lying on an imaginary line substantially horizontal relative to said housing.

* * * * *